United States Patent [19]

Ishii

[11] Patent Number: 4,471,695

[45] Date of Patent: Sep. 18, 1984

[54] TWO-SIDED PRINTING MACHINE

[75] Inventor: Koji Ishii, Hiroshima, Japan

[73] Assignee: Ryobi Ltd., Hiroshima, Japan

[21] Appl. No.: 405,775

[22] Filed: Aug. 6, 1982

[30] Foreign Application Priority Data

Aug. 7, 1981 [JP] Japan ..... 56-124508

[51] Int. Cl.[3] ..... B41F 7/02; B41F 21/08

[52] U.S. Cl. ..... 101/217; 101/231

[58] Field of Search ..... 101/137, 217, 142, 220, 101/177, 179, 229, 230, 232, 242, 231, 180, 224, 225; 271/198, 82

[56] References Cited

U.S. PATENT DOCUMENTS

| | | | |
|---|---|---|---|
| 2,374,668 | 5/1945 | Davidson | 101/232 X |
| 2,865,289 | 12/1958 | Fowlie et al. | 101/232 |
| 2,911,907 | 11/1959 | Davidson | 101/137 |
| 3,664,261 | 5/1972 | Dahlgren | 101/232 X |

FOREIGN PATENT DOCUMENTS

| | | | |
|---|---|---|---|
| 2744577 | 4/1978 | Fed. Rep. of Germany | 101/229 |

*Primary Examiner*—J. Reed Fisher

*Attorney, Agent, or Firm*—Sughrue, Mion, Zinn, Macpeak & Seas

[57] ABSTRACT

A two-sided printing machine having a rubber cylinder with an opening in an outer wall thereof. A chain delivery gripper mechanism is freely inserted in the opening as a chain delivery section turning in association with the rotation of said rubber cylinder. An operating mechanism operates the gripper mechanism when it is inserted in the opening so that the gripper grips a sheet delivered out of a sheet inserting section and is provided in association with the rotation of said rubber cylinder. A hooking member is provided in the opening to fixedly lay a blanket on the rubber cylinder under tension.

13 Claims, 8 Drawing Figures

TWO-SIDED PRINTING MACHINE

BACKGROUND OF THE INVENTION

This invention relates to a two-sided printing machine which is compact and in which sheets can be readily gripped in a series of printing steps from a sheet feeding step to a sheet discharging step.

In a conventional two-sided printing machine, as shown in FIG. 1, a sheet is conveyed from a sheet feeding section A′ through a sheet conveying mechanism B′ to a sheet inserting section C′. Then, the sheet is placed between a rubber blanket cylinder 102 and a blanket cylinder 103. Plate cylinders 101 and 104 are inked by inking devices E′ and F′. Therefore, the patterns on the plate cylinders are transferred to the blanket cylinders 102 and 103, so that the sheet is subjected to two-sided printing. The sheet thus printed at station H′ is delivered out by a chain delivery section D′.

In the conventional two-sided printing machine, the sheet inserting section C′ is near the blanket cylinder 103. This is shown schematically in FIG. 1. Also, a gripping mechanism in the chain delivery section, adapted to grip a printed sheet delivered from the impression cylinder 103, is provided near and downstream of the blanket cylinder 103. Therefore, it is rather difficult to clean the blanket cylinders and to replace the blanket on the blanket cylinder 103. Furthermore, in a series of printing steps, a sheet is gripped twice, that is, when the sheet is transferred from the sheet inserting section C′ to the blanket cylinder and when it is transferred from the blanket cylinder to the chain delivery section D′. There are gaps in the handling of the sheet in a positive manner as the printing steps are performed.

Accordingly, operations for stabilizing the flow of sheets from the sheet feeding section to the sheet delivery section are intricate, and the length of the entire machine is therefore necessarily large. In these respects, the conventional two-sided printing machine is disadvantageous.

SUMMARY OF INVENTION

In view of the foregoing, an object of the invention is to provide a two-sided printing machine in which a chain delivery gripper goes into one of the blanket cylinders and the gripper directly grips a sheet delivered out of a paper inserting section and transfers it to a sheet delivering section. By this technique, the above-described various drawbacks accompanying both-side printing machines have been eliminated.

Another object of this invention is to provide a two-sided printing machine in which a sheet is positively handled in all stages of the operation.

This invention will be described in greater detail by referring to the drawings and the description of the preferred embodiment that follows.

DESCRIPTION OF THE PREFERRED EMBODIMENT

One example of a both-side printing machine according to this invention will be described with reference to the accompanying drawings.

Figure 1:
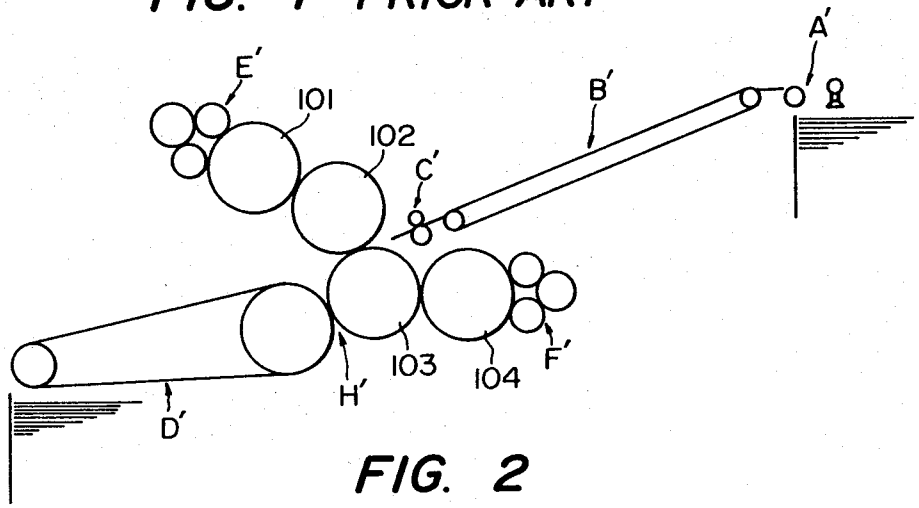
FIG. 1 PRIOR ART
FIG. 1 is an explanatory diagram showing the arrangement of a conventional two-sided printing machine.
Figure 2:
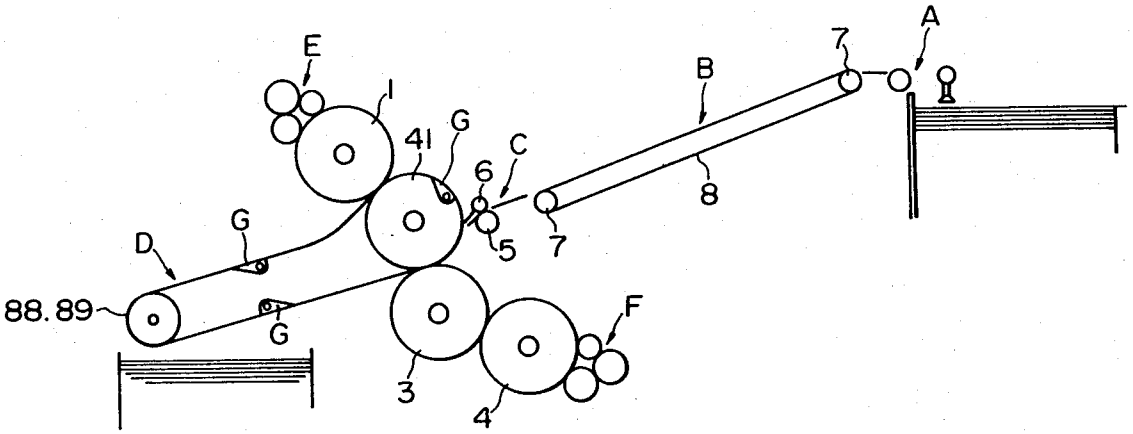
FIG. 2 is an explanatory diagram showing the arrangement of a two-sided printing machine according to this invention.
Figure 3:
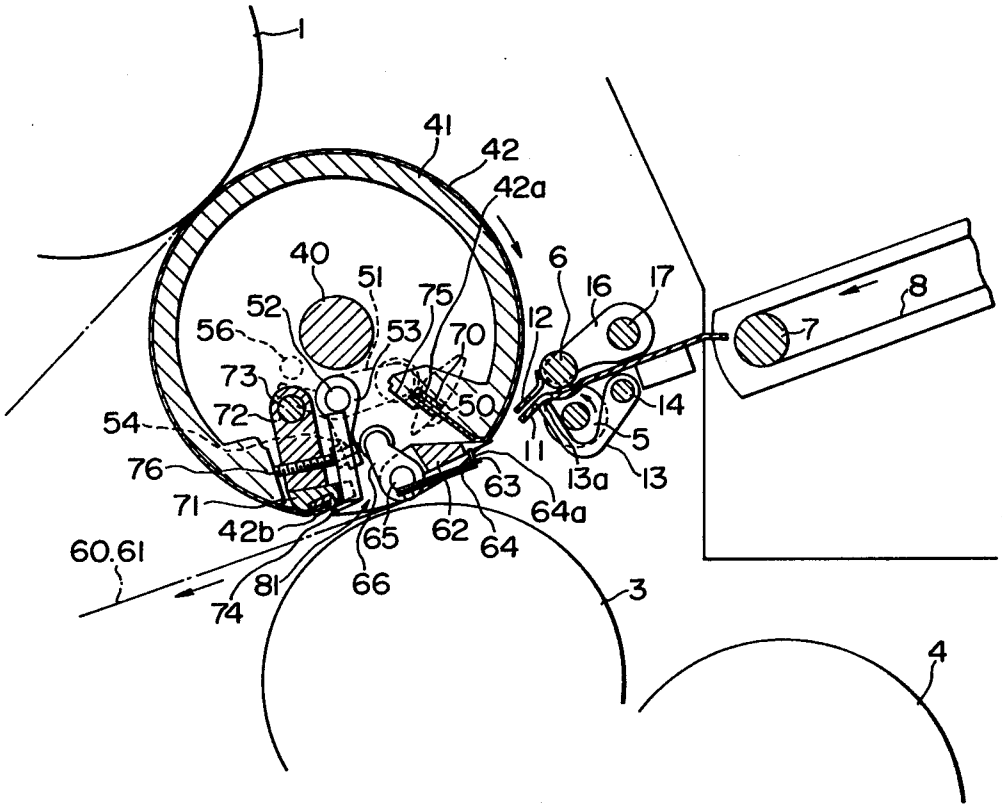
FIG. 3 is a central sectional view of a sheet inserting section and a blanket cylinder.
Figure 4:
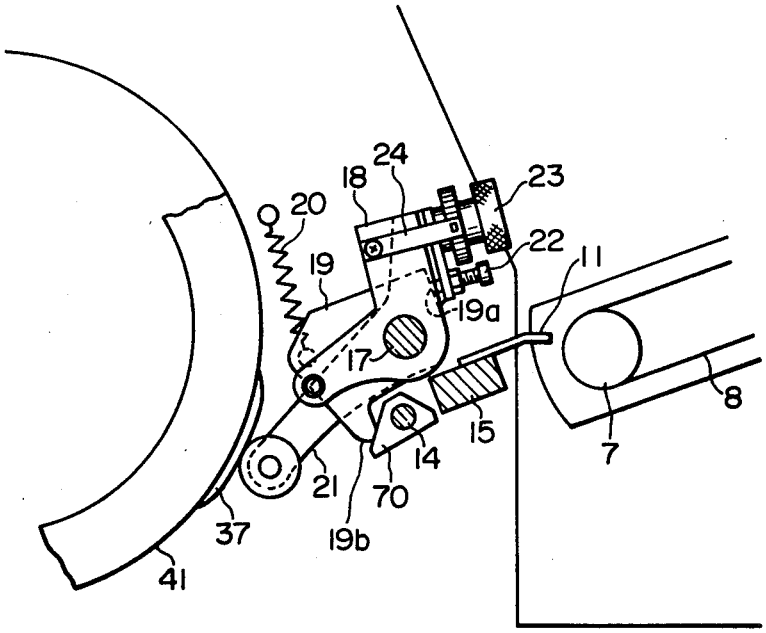
FIG. 4 is a central sectional view of the sheet inserting section.
Figure 5:
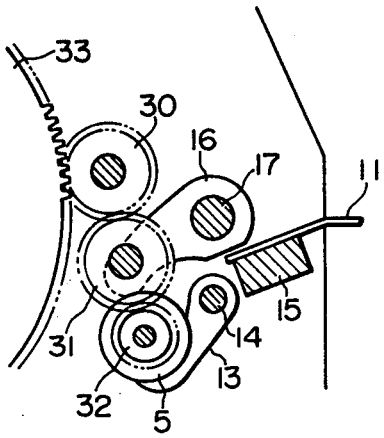
FIG. 5 is an explanatory diagram showing the arrangement of drive mechanism for the sheet inserting section.
Figure 6:
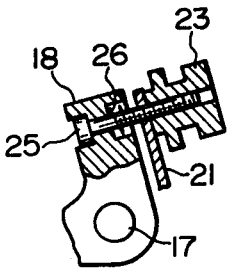
FIG. 6 is an explanatory diagram showing the arrangement of a sheet feed adjusting knob in the sheet inserting section.
Figure 7:
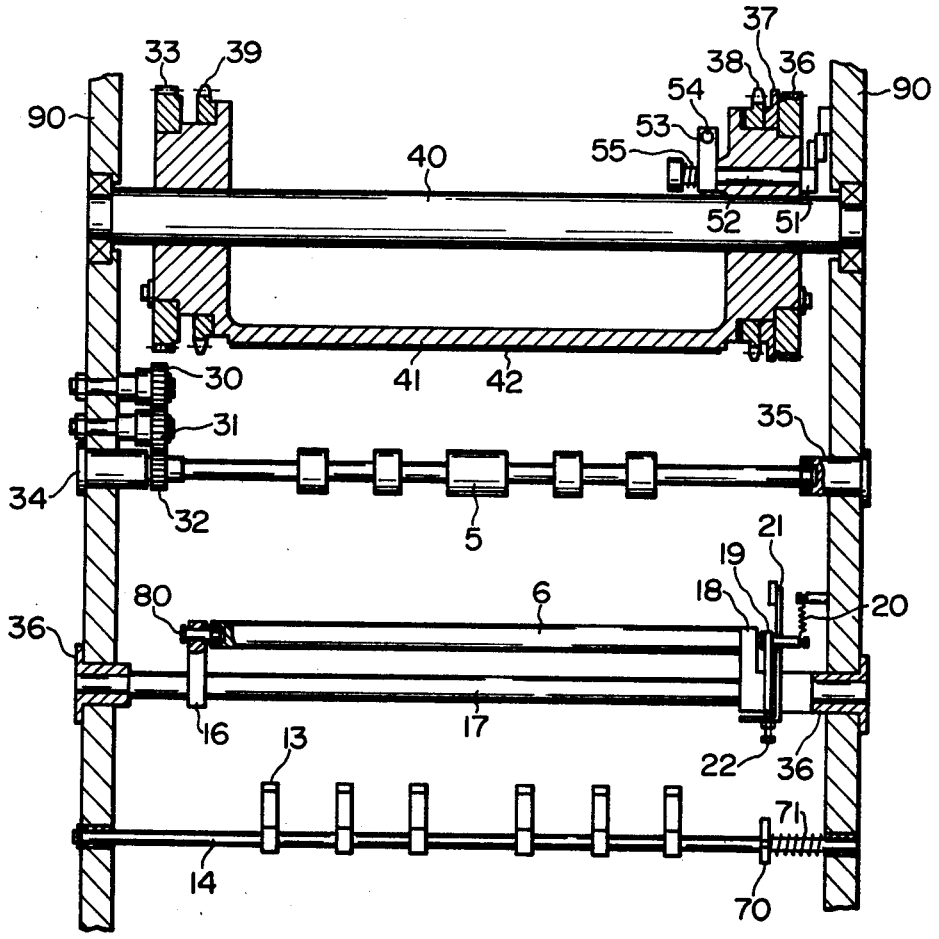
FIG. 7 is an unfolding diagram, partially cut-away, showing the sheet inserting section and the blanket cylinder.

In FIGS. 2 through 8, reference character A designates a sheet feeding section and reference character B, a sheet conveying mechanism comprising rollers 7 and 7 and a belt 8, for conveying a sheet to a sheet inserting section C. In the sheet inserting section C, a sheet is temporarily regulated by a stop finger 13 as shown in FIG. 3. When an upper roller 6, moved up and down by the action of a cam 37, is brought into contact with a lower roller 5 which is turned to clamp a sheet, the sheet is delivered to a rubber blanket cylinder 41. The sheet is further delivered by being gripped with a chain delivery gripper G which can freely move in the blanket cylinder 41. In this operation, patterns are transferred to the blanket cylinder 41 and another blanket cylinder 3 from plate cylinders 1, 4 which are inked by inking devices E and F, and both sides of the sheet are printed. The sheet thus printed is delivered out by a chain delivery section D.

As shown in FIGS. 3–7, in the sheet inserting section C, a sheet is guided by a lower sheet guide 11 and an upper sheet guide 12. The end 13*a* of the stop finger 13 is at a higher level than a through-hole in the lower sheet guide 11, so that the sheet is temporarily regulated. When the stop finger 13 is swung downwardly by the cam 37, the sheet is released. At the same time, the upper roller 6 is moved downwardly to contact the lower roller 5, so that the sheet is delivered.

The cam 37 is fixedly secured to one side of the blanket cylinder 41 and is turned together with a blanket cylinder shaft 40. When a lever 21 is turned counterclockwise by the cam 37, an arm 18 is turned counterclockwise by a compression spring 26 shown in FIg. 6. The layer 21 is loosely fitted on the shaft 17, and the arms 18 and 16 are fixedly secured to the shaft 17. The upper roller 6 is rotatably mounted on the ends of the arms 16 and 18 with a pin 80 (see FIG. 7). A bolt 22 is screwed into the lever 21. Therefore, when the bolt 22 is turned, the base end 19*a* of the lever 19 which is loosely fitted on the shaft 17 is pushed by the bolt 22. Also, a cam 70 fixed to the shaft 14 is pushed down by the front end 19*b* of the lever 19, so that the stop finger 13 secured to the shaft 14 is turned counterclockwise. That is, the belt 22 should be adjusted so that, when the upper roller 6 contacts the lower roller 5, the end of the stop finger 13 is below the lower sheet guide 11.

A screw 25 is inserted into one end portion of the arm 18. A knob 23 is rotatably mounted on one end portion of the screw 25. One end portion of a leaf spring 24, the other end portion of which is fixedly secured to the arm 18, elastically abuts against the knob 23, so that rotation of the knob 23 is elastically regulated by the leaf spring 24. When the knob 23 is turned, the amount of rotation of the lower roller 5 due to the engagement of the lever 21 with the cam 37 is changed, and accordingly the period of time for which the upper roller 6 is moved downwardly to contact the lower roller 5 is adjusted. This adjustment serves as a timing control for the operation (opening and closing) of a gripper (to be described later).

When the lever 21 is disengaged from the cam 37, the lever 19 is restored by the elastic force of the spring 20, while the stop finger 13 is also restored by a torsion spring 71. Accordingly, the stop finger 13 protrudes from the lower sheet guide 11 to be ready for temporarily regulating the next sheet. The lower roller 5 is turned as follows: The lower roller 5 has a gear 32 at one end. The gear 32 is engaged through idle gears 30 and 31 with a gear 33 of the blanket cylinder 41. Therefore, as the blanket cylinder 41 is turned, the lower roller 5 is also turned.

Figure 8:
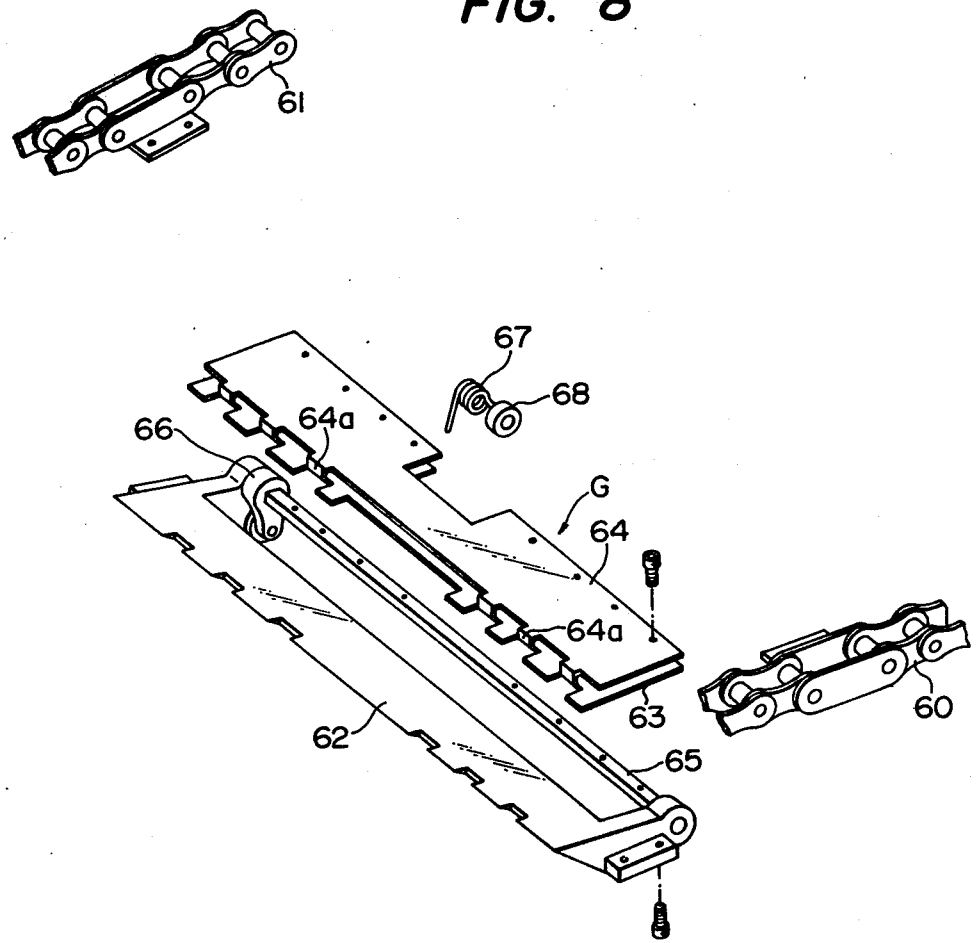
FIG. 8 is an exploded perspective view showing a chain gripper.

The blanket cylinder 41 has sprockets 38 and 39 (FIG. 7) at both ends thereof. Chains 60 and 61 (FIG. 8) are laid over the sprockets 38 and 39 and the sprockets 88 and 89 (FIG. 2) which are provided in the sheet delivery section, respectively. The grippers G are provided between the chains 60 and 61 and can freely extend in the opening 81 of the blanket cylinder 41 (FIG. 8). In each gripper G, a gripper base 62 is provided between the chains 60 and 61. A shaft 65, to which a lever 66 is fixedly secured, is rotatably provided between two walls of a cut which is located at the rear edge of the gripper base 62. A gripper piece 63 and a sheet stopper 64, superimposed one on another are mounted on the shaft 65. The gripper piece 63 and the sheet stopper 64 are maintained close to the gripper base 62 by a torsion spring 67. As the sprockets 39 and 38 are turned together with the blanket cylinder 41, the chains 60 and 61 with the grippers are turned.

A gripper operating (opening and closing) mechanism provided at one end of the rubber cylinder 41 will be now described by reference to FIG. 3. An arm 53 and a lever 51 are fixedly secured to a shaft 52. The arm is turned as a cam 50 secured to a frame 90 and is engaged with the lever 51. A torsion spring 55 is provided for the shaft 52 so that the lever 51 is urged clockwise at all times. Upon disengagement of the cam 50 from the lever 51, the latter 51 is returned by the elastic force of the torsion spring 55 to abut against the stopper 56. The arm 53 operates to turn the aforementioned lever 66 through a screw 54. In this connection, the screw 54 can be used to adjust the amount of rotation of the lever, i.e., the angle between the gripper piece 63 and the sheet stopper 64.

A hooking member 42*a* with a groove 70 for fixing one edge of a blanket 42 is fitted to one side of the opening 81 of the blanket cylinder 41. A holder 72 is loosely fitted to a shaft 73 which is fixedly secured to the interior of the blanket cylinder 41. A metal part 71 is secured to the holder 72. A hooking member 42*b* is mounted on the metal part 71. A pulling knob screw 76 is provided at the middle part of the holder 72, in order to adjust the tension of the blanket. Guide plates 74 and 75 are secured to the metal part 71 and one side of the opening 81 of the blanket cylinder 41 so that the blanket laid over the blanket cylinder 41 will not come off.

In operation, sheet conveyed by the belt 8 is temporarily regulated by the end portion of the stop finger 13, so that the timing of printing is adjusted. Simultaneously when the sheet thus temporarily regulated is released by the engagement of the cam 37 with the lever 21, the upper roller 6 contacts the lower roller 5 in such a manner that the sheet is held therebetween. Therefore, the sheet is further conveyed through the sheet guides 11 and 12 as the lower roller 5 is turned. In this operation, a gripper G is inserted in the opening 81 of the blanket cylinder 41. On the other hand, the cam 50 engages with the lever 51, so that the arm 53 is turned counterclockwise as shown in FIG. 3. Accordingly, the lever 66 is pushed and turned by the arm 53, so that the shaft 65 is turned.

As a result, the gripper piece 63 and the sheet stopper 64 open with respect to the gripper base 62. Accordingly, the sheet is inserted between the gripper piece 63 and the gripper base 62, and the sheet is positioned with the front edge of the sheet abutted against the stopper piece 64*a* of the sheet stopper 64. Next, the lever 51 is disengaged from the cam 50, whereupon the gripper piece 63 and the sheet stopper 64 are closed with the aid of the torsion spring 67, to fixedly grip the sheet. As the blanket cylinder 41 is turned, the chains 60 and 61 are also turned. Therefore, the sheet is placed between the blanket cylinder 41 and the blanket cylinder 3 while being gripped by the gripper G and is then subjected to two-sided printing. Thereafter, the sheet is sent to the sheet delivery mechanism as it is, where the gripper piece 63 and the sheet stopper 64 are opened by a mechanism similar to that comprising the lever 51 and the cam 50. As a result, the printed sheet is discharged.

In transferring a sheet from the sheet inserting section to the chain delivery section, the sheet is gripped only once by a gripper G as described above, which contributes to stabilization in flow of sheets. The sprockets provided at both ends of the blanket cylinder 41 form a part of the chain delivery section and each gripper goes into the opening of the blanket cylinder 41 to grip a sheet. Therefore, the printing machine is compact, and not only cleaning the blanket cylinders but also replacing the cylinder blanket 42 can be readily and quickly achieved without being obstructed by the chain delivery section. Since the chain delivery section is at a higher position than the conventional chain delivery section, the amount of sheet delivery is increased. Thus, printing can be carried out in accordance with the amount of sheet delivery without removing printed sheets from the delivery stock.

It is apparent that improvements and modifications to this system can be effectuated without departing from the essential scope thereof.

What is claimed is:

1. A two-sided printing machine comprising:

a sheet feeding mechanism;

a first blanket cylinder for printing one side of a sheet;

a second blanket cylinder, of substantially the same diameter as said first cylinder, for printing an opposite side of said sheet, said second blanket cylinder having an opening in an outer wall thereof;

first and second plate cylinders in rolling contact with said first and second blanket cylinders, respectively;

sheet delivery section means including a plurality of gripper means;

gripper operating means for moving each of said gripper means into and out of said opening and toward and away from said second blanket cylinder continuously to grip said sheet to be printed and to release said sheet subsequent to being printed, only one sheet being fed by said feeding mechanism for each rotation of said second blanket cylinder; and hooking means provided in said opening to fixedly secure a blanket on said second blanket cylinder under tension;

wherein said second blanket cylinder comprises first sprocket means, and said means for moving said gripper means comprises second sprocket means spaced apart from said first sprocket means as well as endless chain means wrapped around said first and second sprocket means, both of said sprocket means rotating in vertical planes so that said chain means has an upper chain portion and a lower chain portion;

said delivery section means having the function of delivering the sheet, without any further gripping thereof and without turning thereof, along a linear path along said lower portion of said chain means.

2. A two-sided printing machine as in claim 1, wherein said second blanket cylinder has a cam surface thereon, said gripper operating means including a cam follower bearing on said cam surface, first and second pinch rollers and means responsive to said cam follower for selectively moving one of said pinch rollers into engagement with the other.

3. A two-sided printing machine as in claim 2, further comprising means to drive the other of said pinch rollers in correspondence with rotation of said second blanket cylinder.

4. A two-sided printing machine as in claim 3, further comprising stop means actuated by said cam surface to release a sheet for delivery to said pinch rollers, wherein release occurs in a timed relationship with movement of one of said pinch rollers.

5. A two-sided printing machine as in claim 1, wherein each of said gripper means comprises; a gripper base extending laterally through said second blanket cylinder, a gripper piece and a sheet stopper superimposed thereon and mounted on a shaft and spring means to bias said gripper piece and sheet stopper into engagement with said gripper base.

6. A two-sided printing machine as in claim 5, wherein said gripper operating means comprises cam means internal in said second blanket cylinder and responsive to rotation of said second blanket cylinder, a lever mechanism operable by said cam means to open said gripper piece relative to said gripper base and means to bias said lever mechanism in a direction corresponding to rotation of said second blanket cylinder.

7. A two-sided printing mechanism as in claim 1, wherein said hooking means comprised a first hooking member having a groove for fixing one edge of a blanket to one side of the opening in said second blanket cylinder, a second hooking member secured to said second blanket cylinder and guide plates secured to one side of said opening to anchor said blanket to said second blanket cylinder.

8. A two-sided printing machine as claimed in claim 1, wherein said first sprocket means includes a pair of first sprockets, said second sprocket means includes a pair of second sprockets, said chain means including a pair of endless chains, each of said chains being wrapped around one of said first sprockets and one of said second sprockets, said plurality of gripper means being coupled between said pair of chains and spaced along the length thereof.

9. A two-sided printing machine as claimed in claim 1, wherein each of said gripper means grips a sheet to be printed at said second blanket cylinder when each said gripper means is in said opening, each said gripper means releasing a sheet subsequent to being printed in a vicinity of said second sprocket means.

10. A two-sided printing machine as claimed in claim 9, wherein said gripper operating means rotates said second blanket cylinder.

11. A two-sided printing machine as claimed in claim 1, wherein said gripper operating means moves said plurality of gripper means along an arcuate path around a shaft of said second blanket cylinder in conjunction with said opening.

12. A two-sided printing machine as claimed in claim 11, wherein said arcuate path subtends an angle greather than 180°.

13. A two-sided printing machine as claimed in claim 1, wherein said second blanket cylinder is disposed above said first blanket cylinder.

* * * * *